US008695287B1

(12) United States Patent
Francies, III

(10) Patent No.: US 8,695,287 B1
(45) Date of Patent: Apr. 15, 2014

(54) PRECAST PRE-STRESSED CONCRETE TEE LIFT ANCHOR

(71) Applicant: Sidney E. Francies, III, Lithia, FL (US)

(72) Inventor: Sidney E. Francies, III, Lithia, FL (US)

( * ) Notice: Subject to any disclaimer, the term of this patent is extended or adjusted under 35 U.S.C. 154(b) by 0 days.

(21) Appl. No.: 13/929,122

(22) Filed: Jun. 27, 2013

Related U.S. Application Data

(60) Provisional application No. 61/665,039, filed on Jun. 27, 2012.

(51) Int. Cl.
*E02D 35/00* (2006.01)
*E04G 21/14* (2006.01)
*E04H 12/34* (2006.01)

(52) U.S. Cl.
USPC ..... 52/125.4; 52/698

(58) Field of Classification Search
CPC ..... E04B 1/41; E04G 15/04; E04G 21/142
USPC ..... 52/122.1, 125.1, 125.2, 125.4, 125.5, 52/125.6, 698, 699, 700
See application file for complete search history.

(56) References Cited

U.S. PATENT DOCUMENTS

| | | | | |
|---|---|---|---|---|
| 4,087,947 | A * | 5/1978 | Turner | 52/125.4 |
| 4,296,909 | A * | 10/1981 | Haeussler | 249/94 |
| 6,082,700 | A * | 7/2000 | Lancelot et al. | 249/91 |
| 6,575,424 | B2 * | 6/2003 | Domizio | 249/91 |
| 7,127,859 | B2 * | 10/2006 | Domizio | 52/576 |
| 8,024,896 | B2 * | 9/2011 | Azarin | 52/125.4 |
| 2009/0107057 | A1 * | 4/2009 | Hansort | 52/125.4 |
| 2009/0320386 | A1 * | 12/2009 | Mackay Sim | 52/125.4 |
| 2010/0181790 | A1 * | 7/2010 | Fernandez Fernandez | 294/89 |

* cited by examiner

*Primary Examiner* — Mark Wendell
(74) *Attorney, Agent, or Firm* — McGarry Bair PC

(57) ABSTRACT

A lift anchor for a precast pre-stressed concrete tee includes a pair of slender parallel legs each characterized by a longitudinal axis, a first end, and a second end. The first ends join at a slender head. The longitudinal axes define a plane. A pair of oval-shaped feet are forged with the legs perpendicular thereto and characterized by a major axis. The forged feet are configured so that the major axes are either perpendicular or parallel to the plane. The legs and feet can be embedded in a precast pre-stressed concrete tee so that the head is exposed for coupling with a hoisting device.

18 Claims, 5 Drawing Sheets

PRECAST PRE-STRESSED CONCRETE TEE LIFT ANCHOR

CROSS-REFERENCE TO RELATED APPLICATION

This application claims the benefit of U.S. provisional application Ser. No. 61/665,039, filed Jun. 27, 2012, which is incorporated by reference herein in its entirety.

BACKGROUND OF THE INVENTION

1. Field of the Invention

The invention relates to a lifting assembly for pre-stressed precast concrete tees.

2. Description of the Related Art

It is known to utilize pre-stressed concrete building components, such as single and double tees, that are precast prior to shipment and installation on a construction project. A precast concrete tee can be very heavy, and may be cast and removed from a mold, placed on a transporting vehicle, and installed at the construction site as a single unit using cranes, gantries, helicopters, or other equipment suitable for lifting heavy objects.

To facilitate the attachment of hooks, cables, chains, and the like, for moving such loads, steel lifting anchors may be integrated into the concrete web(s) and center portion of the flange during casting of the tees. FIG. 1A illustrates a known square wire lifting anchor 10 having an inverse vee-shaped head 12, transitioning to a pair of generally parallel legs 14, in turn transitioning to a pair of laterally disposed feet 16 formed by bending an end of each leg 14 so that the feet 16 are generally orthogonal to the legs 14 and parallel to each other. FIG. 1C is a variation of the square wire lifting anchor of FIG. 1A where prime numerals in FIG. 1C are used to designate like parts of the lifting anchor of FIG. 1A. The only difference between the anchors of FIGS. 1A and 1C is that the feet 16' of FIG. 1C are bent orthogonal to the legs 14' but lie in the plane of the inverse vee-shaped head 12' and the parallel legs 14', whereas the feet 16 of FIG. 1A are transverse to the plane of the inverse vee-shaped head 12 and parallel legs 14

FIG. 1B illustrates a known round wire lifting anchor 20 having an inverse vee-shaped head 22, transitioning to a pair of generally parallel legs 24, in turn transitioning to a pair of laterally disposed feet 26 formed by bending an end of each leg 24 into a hook-shape so that the feet 26 are in generally opposed disposition.

The anchor feet of FIGS. 1A-1C may interfere with the positioning of pre-stressing strands, and may extend too near an outside face of the tee, potentially impacting the pull-out strength of the anchor and the bending resistance of the tee. A need exists for a lifting anchor for pre-stressed precast concrete tees that may solve the above-described problems with known tee anchors.

BRIEF SUMMARY OF THE INVENTION

A lift anchor for a precast pre-stressed concrete tee includes an elongated slender rod having a pair of slender parallel legs each characterized by a longitudinal axis, a first end, and a second end. The first ends join at a slender head. The longitudinal axes define a plane. A pair of oval-shaped feet are forged with the legs perpendicular thereto and characterized by a major axis. The forged feet are configured so that the major axes are either perpendicular or parallel to the plane. The legs and feet can be embedded in a precast pre-stressed concrete tee so that the head is exposed for coupling with a hoisting device.

In one embodiment, the lift anchor may be forged from steel rod.

In another embodiment, the head may be arcuate or inverse vee-shaped.

In yet another embodiment, the head may be coplanar with said legs. Further, the oval-shaped feet may be characterized by a minor axis, and transition to said legs through circular plates, each having a diameter smaller than said minor axis.

In an alternate embodiment, a combination lift anchor described above and concrete tee includes a concrete tee flange transitioning orthogonally to a concrete tee web characterized by a web longitudinal axis parallel to the flange. A pre-stressing strand is embedded in the web and extends the length of the web parallel to the web longitudinal axis. The orientation of the plane of the embedded legs and feet relative to the pre-stressing strand is perpendicular, parallel, or oblique.

DETAILED DESCRIPTION OF EMBODIMENTS OF THE INVENTION

As may be used herein, the following terms have the associated definitions unless otherwise indicated:

"Axis" means "a real or imaginary straight line about which a three-dimensional body is symmetrical."

"Longitudinal" with respect to a body means "correlating with an axis of a body that is parallel to the longitudinal axis."

"Plane of symmetry" means "a real or imaginary plane that divides a body such that each side of the body is a mirror reflection of the other."

"Oblong" means "deviating from a square, circular, or spherical form by being elongated in one direction."

The following description and drawings of embodiments of the invention are set forth with respect to a precast concrete single tee. However, the description and drawings may be equally applicable to other configurations, such as precast concrete double tees, triple tees, and the like. The description and drawings may also be equally applicable to other precast concrete shapes, and references to tees should not be considered as limiting.

Figure 1C:
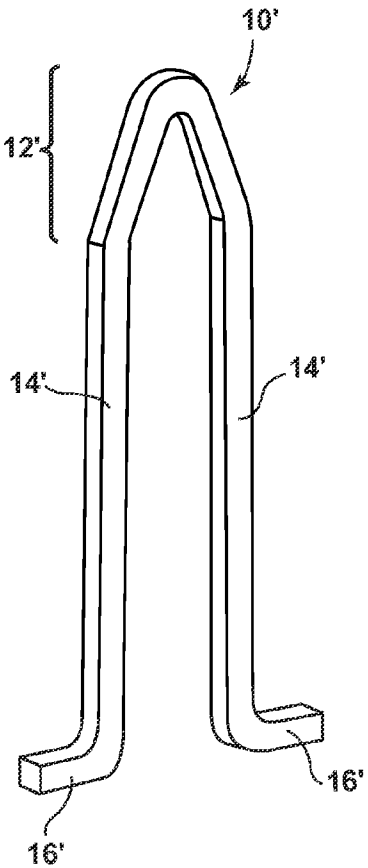
FIG. 1C (PRIOR ART)
FIG. 1C is a perspective view of a modified form of the first prior art double tee lift anchor.
Figure 1B:
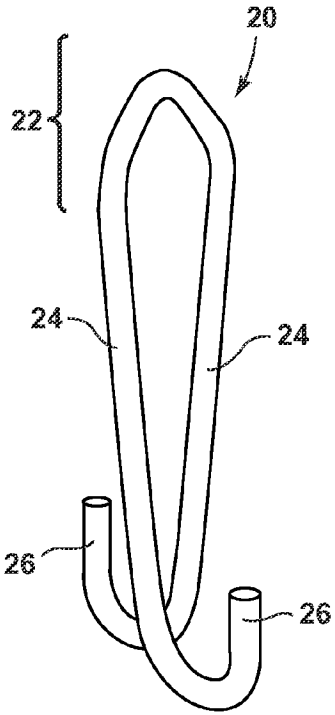
FIG. 1B (PRIOR ART)
FIG. 1B is a perspective view of a second prior art double tee lift anchor.
Figure 1A:
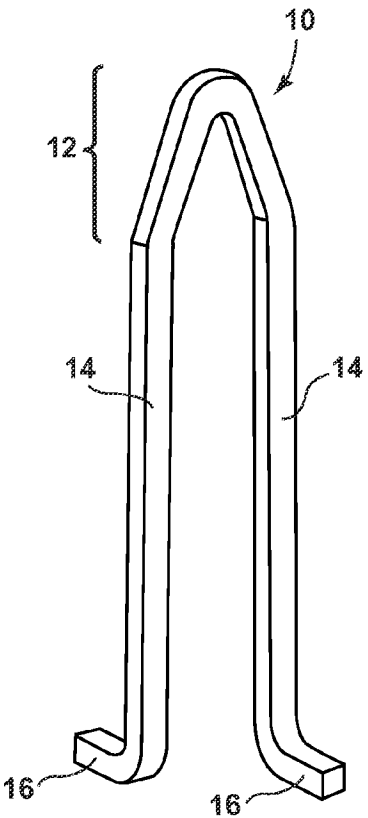
FIG. 1A (PRIOR ART)
FIG. 1A is a perspective view of a first prior art double tee lift anchor.
Figure 2:
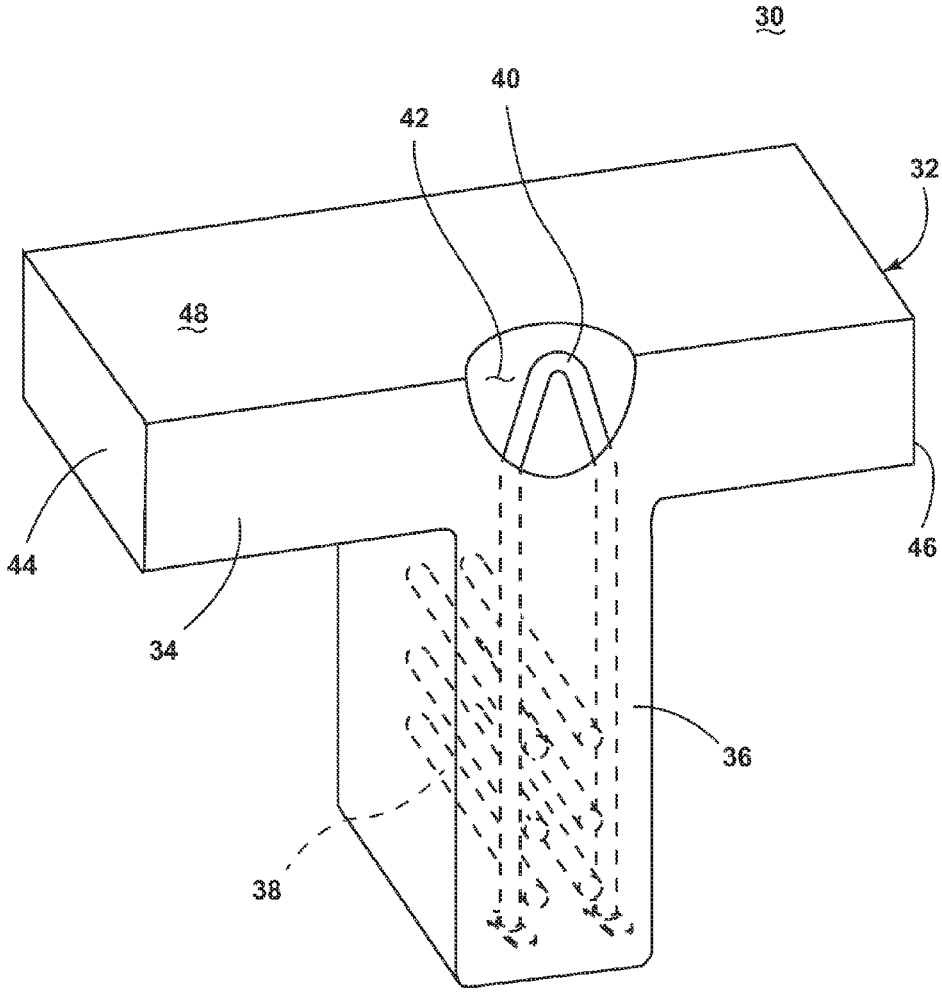
FIG. 2 is a perspective partly sectional view of a precast pre-stressed concrete single tee including an exemplary embodiment of a lift anchor according to the invention.

Referring to the drawings, FIG. 2 illustrates a precast pre-stressed concrete single tee assembly 30 including a precast concrete tee 32 having a flange 34 and a web 36 extending orthogonally therefrom. The flange 34 may terminate in a pair of parallel opposed flange faces 44, 46 and may include a planar working surface 48 orthogonal to and opposite the web 36. Shown in phantom, a plurality of spaced-apart steel pre-stressing strands 38 may extend longitudinally along the web 36 in a generally known configuration. The concrete tee 32 may include additional steel reinforcement, such as rods, mesh, and the like, which is not shown for purposes of clarity. A forged foot lift anchor 40 may be forged from steel or other material having sufficient strength and durability for the purposes described herein, and may extend from within the flange 34 into the web 36.

Figure 3A:
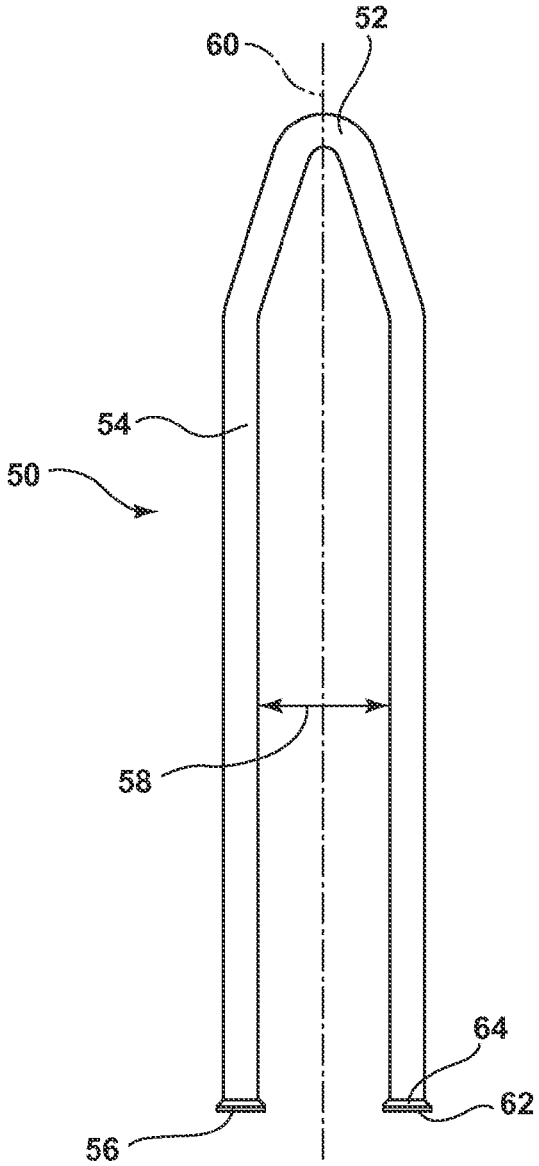
FIGS. 3A and B are front and side elevation views, respectively, of a first embodiment of the invention.

Referring now to FIGS. 3A and B, a first exemplary embodiment is illustrated of a forged transverse foot anchor 50. The anchor 50 may be forged from cylindrical steel rod, and may be somewhat clothes-pin shaped. The anchor 50 comprises an elongated slender rod that includes a head 52, and a pair of parallel elongate legs 54, each leg terminating in an oblong transverse foot 56.

The head 52 may be curved, or have the shape of a somewhat parabolic arch or inverse vee, with dimensions suitable for receipt of a lifting device such as a hook, a clevis, and the like. Referring again to FIG. 2, the head may terminate somewhat below the plane of the working surface 48 in a cavity 42 to facilitate coupling with a lifting device; the cavity may be patched with a suitable material after final uncoupling of the lifting device from the head 52.

The head 52 may transition to the legs 54 to define a selected leg separation 58 and a longitudinal axis 60 intermediate and parallel to the legs 54. The leg 54 is illustrated as transitioning to the transverse foot 56 through a circular plate 62 having a diameter smaller than the minor axis of the oblong foot 56 and a circumferential bevel 64. Alternatively, the foot 56 may transition from the leg 54 without an intervening plate. As well, other transition elements may be utilized between the leg 54 and the foot 56, such as a circular plate with an unbeveled or rounded circumference, an oblong or square plate, and the like. The selection of a transition element may be based upon a selected forging process, a selected strength of the connection of the foot 56 to the leg 54, and the like.

Figure 3B:
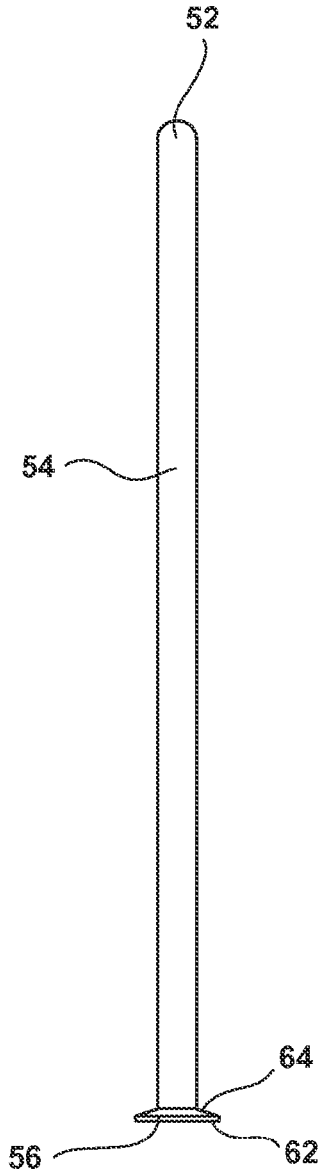

As may be seen in FIGS. 3A and 3B, the major axis of the oblong transverse foot 56 is perpendicular to the plane defined by the legs 54 and the head 52.

Figure 4A:
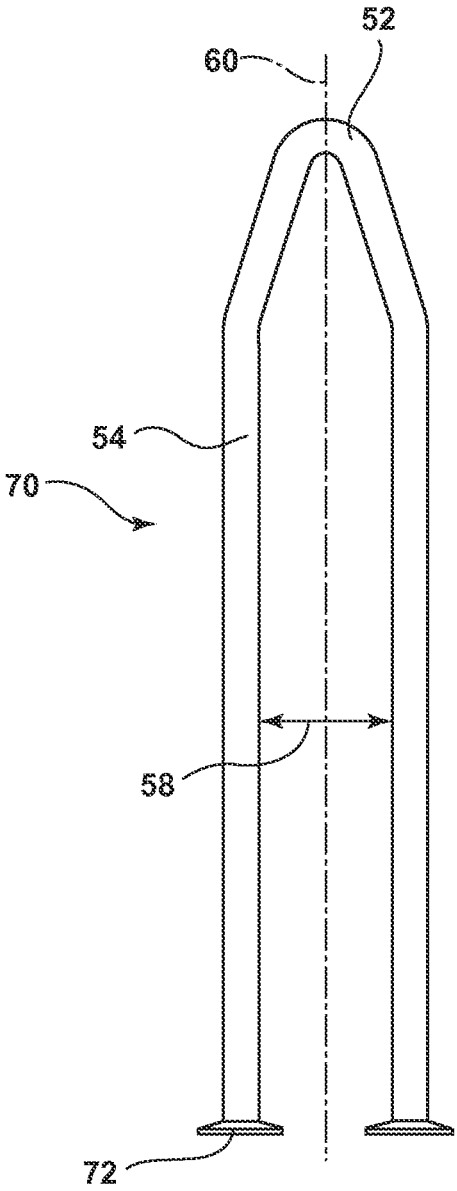
FIGS. 4A and B are front and side elevation views, respectively, of a second embodiment of the invention.
Figure 4B:
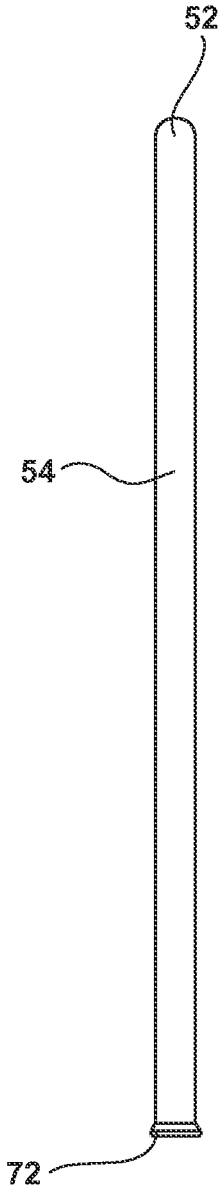

Referring now to FIGS. 4A and B, a second exemplary embodiment is illustrated as a longitudinal foot anchor 70. The longitudinal foot anchor 70 is identical in every respect to the transverse foot anchor 50, except in the orientation of the longitudinal feet 72. Each longitudinal foot 72 is parallel to the plane defined by the legs 54 and the head 52. As a result of the difference in orientation of the feet 56, 72, the outside width of the longitudinal foot anchor 70 is approximately 16% greater than the outside width of the transverse foot anchor 50. The inside width between the longitudinal feet 72 is approximately 30% less than the inside width between the transverse feet 56.

FIGS. 5A and B illustrate a schematic double row parallel configuration 80 of the anchor 70 and pre-stress strands 38 in elevation and plan views, respectively, that may include the longitudinal foot anchor 70 and a double row of pre-stress strands 38 extending on either side of the legs 54. The orientation of the longitudinal feet 72 may enable placement of the pre-stress strands 38 a minimal distance away from the anchor 70, thereby resulting in a maximum distance of the strands 38 from the edges of the web 36.

FIGS. 6A and B illustrate a schematic double row orthogonal configuration 82 of the anchor 50 and pre-stress strands 38 in elevation and plan views, respectively, that may include the transverse foot anchor 50 and a double row of pre-stress strands 38 extending between the legs 54. The orientation of the transverse feet 56 may enable a placement of the pre-stress strands 38 that may minimize interference of the anchor 50 with the strands 38 while moving the strands 38 away from the edges of the web 36.

FIGS. 7A and B illustrate a schematic single row oblique configuration 84 of the anchor 70 and pre-stress strands 38 in elevation and plan views, respectively, that may include the longitudinal foot anchor 70 obliquely straddling a single row of pre-stress strands 38 so that the distance between the legs 54 and the strands 38 is minimized, thereby minimizing the overall width of the anchor 70 and strands 38, maximizing the distance of the strands 38 from the edges of the web 36, and potentially enabling the tee to be cast with a thinner web.

Figure 5:
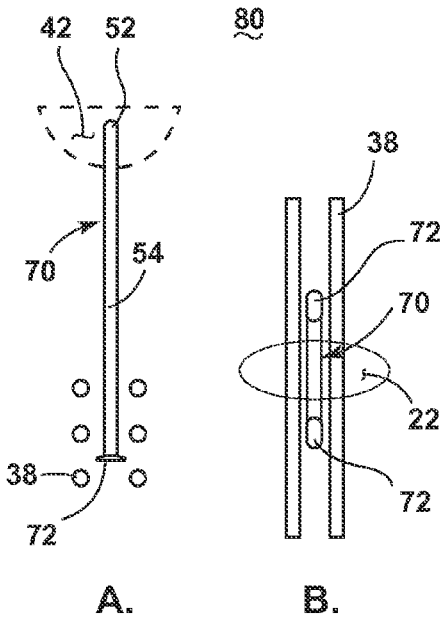
FIG. 5 is a schematic front elevation and top plan view of a first configuration of a lift anchor and pre-stressing strands.
Figure 6:
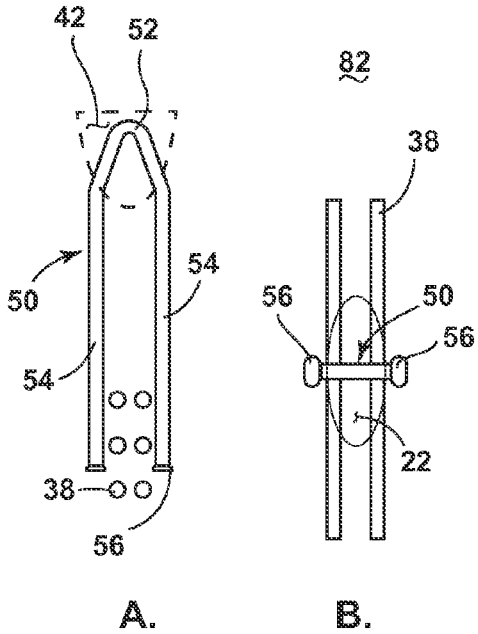
FIG. 6 is a schematic front elevation and top plan view of a second configuration of a lift anchor and pre-stressing strands.
Figure 7:
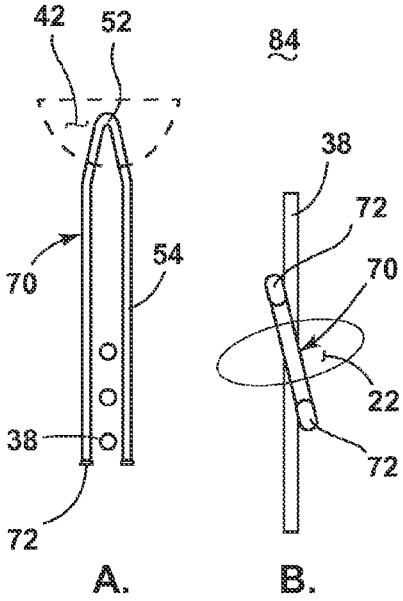
FIG. 7 is a schematic front elevation and top plan view of a third configuration of a lift anchor and pre-stressing strands.

Each of the configurations illustrated in FIGS. 5, 6, and 7 may ensure proper engagement of the anchors 50, 70 and feet 56, 72 in the concrete, may minimize the distance of the strands 38 and/or anchor 50, 70 from the edges of the web 36, and may minimize interference of the feet with the pre-stress strands 38.

While the invention has been specifically described in connection with certain specific embodiments thereof, it is to be understood that this is by way of illustration and not of limitation. For example, the invention has been described with respect to a foot which is oval in appearance. However, it is within the scope of the invention to include any shape of oblong configuration. Reasonable variation and modification are possible within the scope of the forgoing disclosure and drawings without departing from the spirit of the invention, which is defined in the appended claims.

What is claimed is:

1. A lift anchor for a precast pre-stressed concrete tee, said lift anchor comprising:

an elongated slender rod having a pair of slender parallel legs, each leg characterized by a leg longitudinal axis, a first end, and a second end, said first ends transitioning to and joined at a slender head, said pair of leg longitudinal axes defining a plane; and a pair of oblong feet, each foot forged with a leg perpendicular thereto and characterized by a major axis;

wherein said forged feet are configured so that said major axes are one of perpendicular to said plane and parallel to said plane;

wherein said legs and feet are embeddable in a precast pre-stressed concrete tee so that said head is exposed, and coupleable with a hoisting device.

2. A lift anchor in accordance with claim 1 wherein said lift anchor is forged from steel rod.

3. A lift anchor in accordance with claim 1 wherein said head is one of arcuate and inverse vee-shaped.

4. A lift anchor in accordance with claim 1 wherein said head is coplanar with said legs.

5. A lift anchor in accordance with claim 1 wherein said oblong feet are characterized by a minor axis having a length less than the length of said major axis.

6. A lift anchor in accordance with claim 5 wherein said oblong feet transition to said legs through circular plates, each circular plate having a diameter smaller than the length of said minor axis.

7. A combination lift anchor and concrete tee in accordance with claim 6 wherein said minor axis is orthogonal to said major axis.

8. A combination lift anchor and concrete tee in accordance with claim 7 wherein said major axis and said minor axis are orthogonal to said leg longitudinal axis.

9. A combination lift anchor and concrete tee comprising:

a concrete tee flange transitioning orthogonally to a concrete tee web;

said concrete tee web characterized by a web longitudinal axis parallel to said concrete tee flange;

a pre-stressing strand embedded in said concrete tee web and extending the length of said concrete tee web parallel to said web longitudinal axis; and said lift anchor comprising:

an elongated slender rod having a pair of slender parallel legs, each leg characterized by a leg longitudinal axis, a first end, and a second end, said first ends transitioning to and joined at a slender head, said pair of leg longitudinal axes defining a plane; and a pair of oblong feet, each foot forged with a leg perpendicular thereto and characterized by a major axis;

wherein said forged feet are configured so that said major axes are one of perpendicular to said plane and parallel to said plane;

wherein said legs and feet are embeddable in said concrete tee so that an orientation of said plane relative to said pre-stressing strand is one of perpendicular, parallel, and oblique.

10. A combination lift anchor and concrete tee in accordance with claim 9 wherein said lift anchor head is exposed for temporary coupling with a hoisting device.

11. A combination lift anchor and concrete tee in accordance with claim 9 wherein said head is coplanar with said legs.

12. A combination lift anchor and concrete tee in accordance with claim 9 wherein said lift anchor is forged from steel rod.

13. A combination lift anchor and concrete tee in accordance with claim 12 wherein said head is coplanar with said legs.

14. A combination lift anchor and concrete tee in accordance with claim 9 wherein said head is one of arcuate and inverse vee-shaped.

15. A combination lift anchor and concrete tee in accordance with claim 9 wherein said oblong feet are characterized by a minor axis having a length less than the length of said major axis.

16. A combination lift anchor and concrete tee in accordance with claim 15 wherein said oblong feet transition to said legs through circular plates, each circular plate having a diameter smaller than the length of said minor axis.

17. A combination lift anchor and concrete tee in accordance with claim 15 wherein said minor axis is orthogonal to said major axis.

18. A combination lift anchor and concrete tee in accordance with claim 17 wherein said major axis and said minor axis are orthogonal to said leg longitudinal axis.

* * * * *